US006041197A

United States Patent [19]

Kashihara

[11] Patent Number: 6,041,197

[45] Date of Patent: Mar. 21, 2000

[54] CHARGING DEVICE

[75] Inventor: Mabumi Kashihara, Niigata, Japan

[73] Assignee: NEC Corporation, Japan

[21] Appl. No.: 09/239,397

[22] Filed: Jan. 28, 1999

[30] Foreign Application Priority Data

Jan. 30, 1998 [JP] Japan ..... 10-018733

[51] Int. Cl.[7] ..... G03G 15/02

[52] U.S. Cl. ..... 399/50

[58] Field of Search ..... 399/50, 175, 168

[56] References Cited

U.S. PATENT DOCUMENTS 5,479,244 12/1995 Kashihara et al. ..... 399/175

FOREIGN PATENT DOCUMENTS 3101765 3/1991 Japan .
7-98534 4/1995 Japan .
7-281503 10/1995 Japan .

*Primary Examiner*—Susan S.Y. Lee
*Assistant Examiner*—Greg Moldafsky
*Attorney, Agent, or Firm*—Ostrolenk, Faber, Gerb & Soffen, LLP

[57] ABSTRACT

The present invention provides a contact type charging device for applying a lower frequency AC voltage in combination with a DC voltage to an electric charger so as to suppress generation of noise in the electric charger as well as eliminate a Moire image in a half tone image when the DC voltage is overlapped with the lower frequency AC voltage, thus enabling to improve a charge uniformity. The charging device includes: an electric charger 1 that is in contact with an electrostatic latent image carrier 100 and applies a predetermined voltage to the electrostatic latent image carrier 100 for charging it; and a power source consisting of a DC power source 13 and an AC power source 15 for applying to the electric charger 1 a DC voltage in combination with an AC voltage. The AC power source 15 has a frequency of a predetermined value corresponding to a latent image to be formed on the electrostatic latent image carrier 100.

10 Claims, 6 Drawing Sheets

FIG.6

| ELECTROSTATIC LATENT IMAGE CARRIER SPEED (INCH/SEC) | RESOLUTION (DOT/INCH) | FREQUENCY (Hz) | MOIRE IMAGE | CHARGE NON-UNIFORMITY | NOISE |
|---|---|---|---|---|---|
| 1.73 (=40 mm/SEC) | 400DPI | 0 | ○ | × | ○ |
| | | 50 | × | × | ○ |
| | | 70 | △ | △ | ○ |
| | | 100 | ○ | ○ | ○ |
| | | 150 | ○ | ○ | ○ |
| | | 300 | ○ | ○ | ○ |
| | | 400 | ○ | ○ | × |
| | 600DPI | 0 | ○ | × | ○ |
| | | 50 | × | × | ○ |
| | | 100 | △ | △ | ○ |
| | | 125 | ○ | ○ | ○ |
| | | 150 | ○ | ○ | ○ |
| | | 300 | ○ | ○ | ○ |
| | | 400 | ○ | ○ | × |
| 3.54 (= 90 mm/SEC) | 600DPI | 0 | ○ | × | ○ |
| | | 50 | × | × | ○ |
| | | 100 | × | × | ○ |
| | | 150 | △ | △ | ○ |
| | | 200 | △ | △ | ○ |
| | | 300 | ○ | ○ | ○ |
| | | 400 | ○ | ○ | × |

NOTES: ○ NOT GENERATED
△ SLIGHTLY GENERATED
× REMARKABLY GENERATED

CHARGING DEVICE

BACKGROUND OF THE INVENTION

1. Field of the Invention

The present invention relates to an electrical charger for use in an image formation apparatus such as an electro-photographic printer, facsimile, or a copying apparatus.

2. Description of the Related Art

Conventionally, the image formation apparatus of an electro-photographic printer and the like a corona discharge device for charging a surface of an image carrier such as a photo-sensitive body in a process cartridge of the electro-photographic printer. The corona discharge device is advantageous for uniformly charging the surface of the image carrier up to a predetermined potential.

Alternatively, a brush electrical charger can also used. In the brush electrical charger, a charging member is brought into direct contact with the photo-sensitive body to be charged. A roller charger and a film charger are further alternative types of contact type electrical charges.

Here, the voltage applied to the contact type chargers may be only DC voltage or DC voltage in combination with AC voltage.

However, the aforementioned conventional chargers have various problems. In the case of a charger using the corona discharge, there is a problem that ozone is generated around the charger. From the viewpoint of the boundary, it is preferable to suppress the ozone generation to a minimum.

On the other hand, in the case of a contact type charger that can suppress ozone generation, application of DC voltage lowers the charging uniformity in comparison to the corona discharge type charger. Especially in the high resolution range of 600 dpi (dots per inch) or above, fluctuations in resistance as well as in the contact state prevent to obtain a uniform charging, thereby causing undesired lines in a half-tone image.

Moreover, in case of chargers using DC voltage in combination with AC voltage, the charge uniformity is improved in comparison to the case applying only DC voltage. However, if the frequency of the AC voltage is too low, a Moire image is generated. To avoid this, it is necessary to set the AC voltage frequency at a sufficiently high value. More specifically, the AC voltage frequency should be set at a value greater than the number of dots made to pass by rotation of the photosensitive body through a particular position of the charger per unit time, so that charging is carried out in a high frequency region. However, when such a high frequency AC voltage is applied, there is a problem that the charger causes a noise due to vibration.

Japanese Patent Publication (unexamined) A-7-98534 discloses as means for suppressing charge nonuniformity, an AC voltage frequency F defined by a formula as follows: $F \geqq R \times S$, wherein R represents the resolution (dots/inch) and S represents the photo-sensitive body speed (inch/second). The frequency defined by this formula becomes a high frequency wave in case of high resolution, increasing the aforementioned problem of noise.

Japanese Patent Publication (unexamined) A-7-281503 discloses a brush type charging apparatus capable of eliminating a stripe-shaped black paint at a position corresponding to a pinhole present on a photo-sensitive body or a brush trace due to a uniform potential on the photo-sensitive body in half-tone printing.

SUMMARY OF THE INVENTION

It is therefore an object of the present invention to provide a contact type charging device capable of increasing the charge uniformity by applying a low frequency AC voltage over a DC voltage so as to suppress the noise generation in a charger and eliminate a moire in a half-tone image which is generated when the lower frequency AC voltage is applied over the DC voltage.

The charging device according to the present invention comprises: an electric charger that is in contact with an electrostatic latent image carrier and applies a predetermined voltage to the electrostatic latent image carrier; and a power source consisting of a DC power source and an AC power source for applying a DC voltage in combination with an AC voltage to the electric charger, wherein the AC power source has a frequency of a predetermined value corresponding to a latent image to be formed on the electrostatic latent image carrier.

In the charging device according to the present invention, it is preferable that the frequency F (Hz) of the AC power source be in a range defined by $S \times R/D < F < 400$, wherein S (inch/sec) is the surface circumferential speed of the electrostatic latent image carrier, R (dot/inch) is the resolution of an image, and D (dot) is the number of dots in a basic pattern when forming a half tone image.

According to another aspect of the present invention, the DC voltage is a predetermined value in a range from 0.5 to 1.4 kV.

According to yet another aspect of the present invention, the AC voltage has an amplitude of a predetermined value equal to or above 300 V.

According to still another aspect of the present invention, the AC voltage has an amplitude of a predetermined value equal to or below 1000 V.

In a printer for digital printing, a basic pattern of dot matrix for a half-tone is a set of dots such as 8×8 or 10×10. If converting into a frequency the number of the basic patterns passing over the electric charger during an image formation, the frequency F can be expressed as follows: $F=S \times R/8$, $F=S \times R/10$, wherein R (dot/inch) is the resolution, and S (inch/sec) is the speed of the photo-sensitive body speed. This is the frequency for dot passing that is divided by the number of dots contained in a horizontal or vertical direction of the basic pattern.

When applying an AC voltage to the electric charger, if a frequency greater than this frequency of the half-tone basic pattern is applied, it is possible to improve the charging uniformity and to reduce or eliminate moire. In the low frequency region satisfying this condition, it is also possible to suppress the generation of noise.

BRIEF DESCRIPTION OF THE DRAWINGS

FIG. 6 shows examples of relationships between the linear speed of the electrostatic latent image carrier surface, resolution, AC voltage frequency, and Moire image according to the present invention.

DESCRIPTION OF THE PREFERRED EMBODIMENTS

Description will now be directed to an embodiment of the present invention with reference to the attached drawings.

Figure 1:
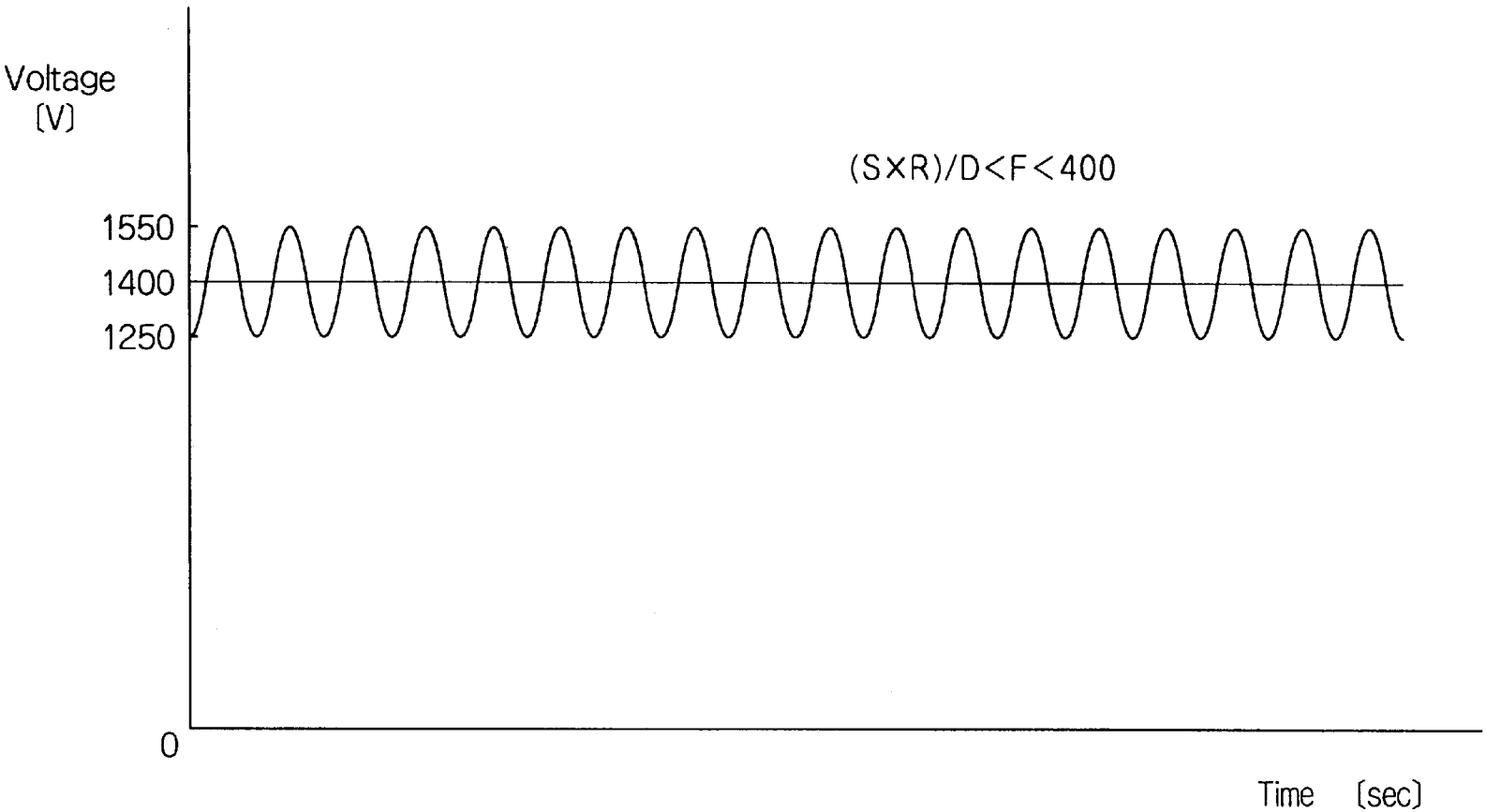
FIG. 1 shows a voltage applied to a charger by a power source of a charging device according to the present invention.
Figure 3:
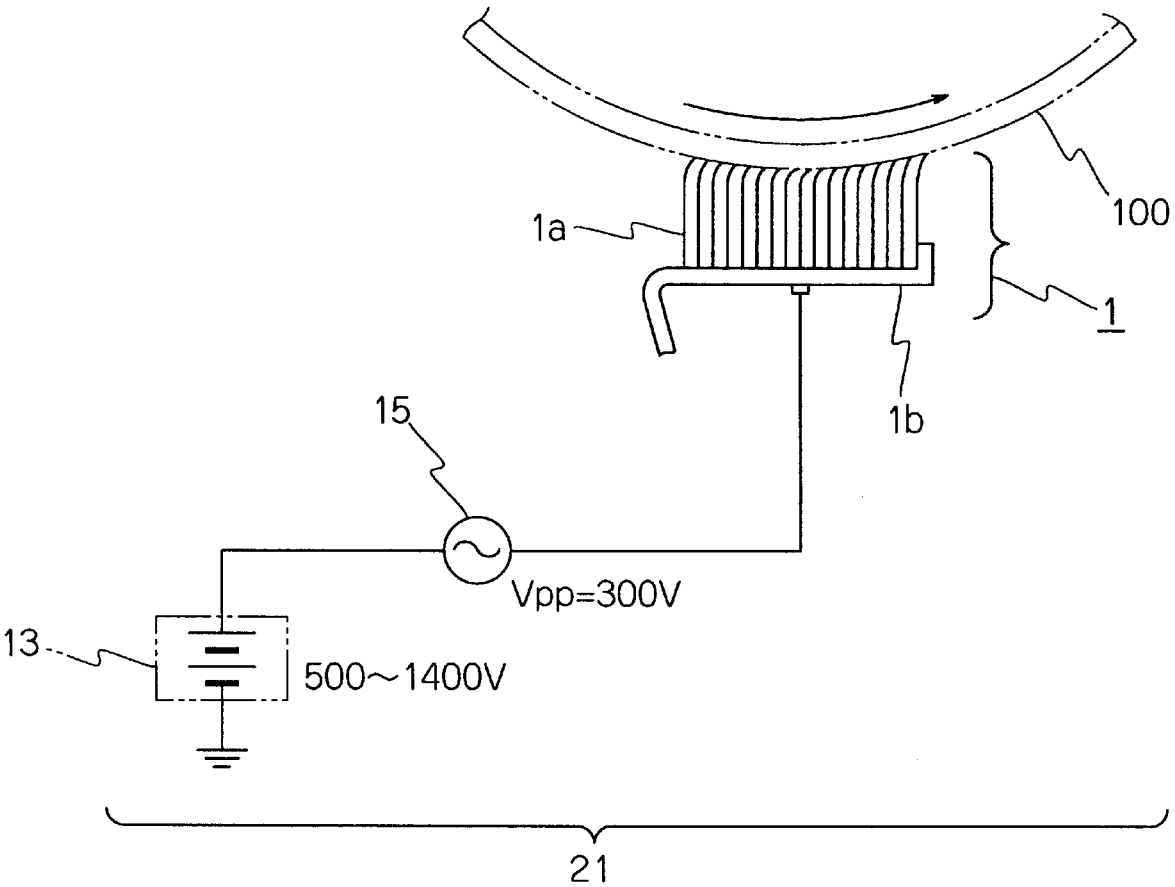
FIG. 3 shows a configuration of the charging device according to the present invention.

FIG. 3 shows a charging device 21 according to the present invention comprising an electric charger 1, a DC power source 13 and an AC power source 15 that are connected to the electric charger 1. The DC power source 13 and the AC power source 15 apply to the electric charger 1 a voltage as shown in FIG. 1. Here, the AC power source 15 has a predetermined frequency corresponding to a latent image formed on an electrostatic latent image carrier 100. More specifically, the frequency F (Hz) is in a range of $S \times R/D < F < 400$, wherein S (inch/second) is a circumferential speed along the surface of the electrostatic latent image carrier 100, R (dot/inch) is the resolution of an image to be formed, and D (dots) is the number of dots in a basic pattern when the image to be formed is in half-tone.

Figure 2:
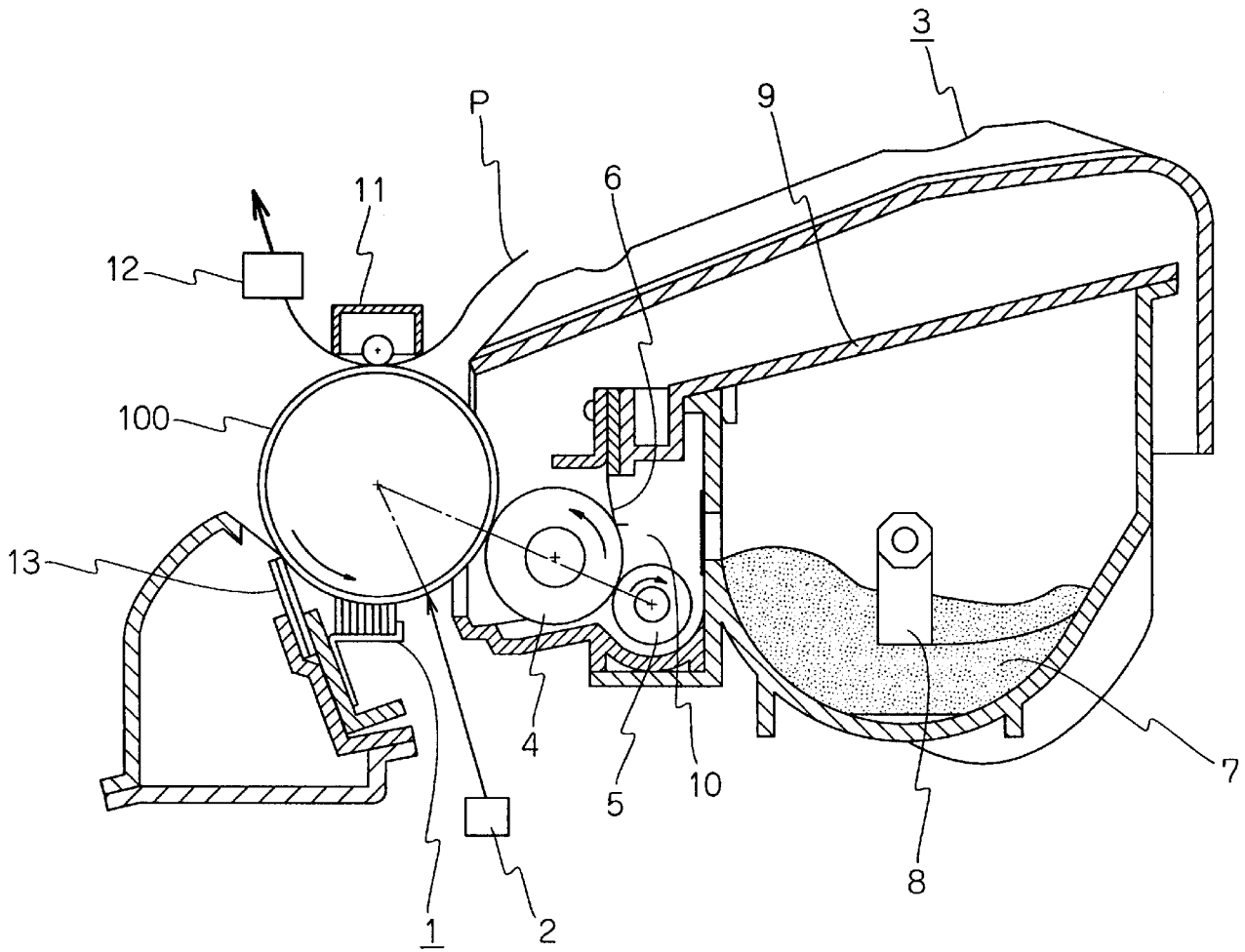
FIG. 2 is a cross-sectional view showing an image formation apparatus that employs the electric charger used in the present invention.

FIG. 2 is a cross-sectional view of an image formation apparatus using the charging device 21 according to the present invention. The image formation apparatus comprises: the electrostatic latent image carrier 100 having a Se photosensitive film as an organic photosensitive compound (OPC) formed on an aluminium pipe; the electric charger 1 in contact with the surface of this electrostatic latent image carrier 100; exposure means 2; development means 3 for supplying toner 7 to the surface of the electrostatic latent image carrier 100; a transfer roller 11 for transferring a toner image developed onto a paper or the like; fixation means 12 for fixing the transferred toner; and a cleaner 13 for removing unused toner.

A minus voltage is applied to the electric charger 1 so as to charge the surface of the electrostatic latent image carrier 100 with minus electricity. An electrostatic latent image (not depicted) is formed by the exposure means 2 on the surface of the charged electrostatic latent image carrier 100. More specifically, as shown in FIG. 3, the electric charger 1 is connected to the DC power source 13 and to the AC power source 15. The DC power source 13 applies a constant voltage to the electric charger 1. Moreover, the AC power source 15 applies to the electric charger 1 AC voltage over the DC voltage. Accordingly, the voltage applied to the electric charger 1 fluctuates by the amplitude of the AC voltage above and below the DC voltage.

The exposure means 2 uses a light source such as a laser, LED, or liquid crystal. The light source is driven according to an image data to form an electrostatic latent image on the electrostatic latent image carrier 100. The development means 3 includes: a toner port 10 having a toner carrier 4 and a supply roller 5; a regulation blade 6; toner 7; mixing member 8; and a toner hopper 9.

The toner 7 as the development agent is introduced by the mixing member 8 to the supply roller 5. This supply roller 5 is made from a conductive or insulation urethane or silicone foamed body, aluminium, or the like. The toner 7 is then introduced to the toner carrier 4. The toner carrier 4 is made from silicon rubber, urethane rubber, nitrile butylene rubber, natural rubber, urethane and silicon foamed body, or the like which has been subjected to a surface treatment.

The toner 7 which has been introduced to the toner carrier 4 is regulated by the regulation blade 6 so as to be applied onto the surface of the toner carrier 4 as a uniform thin layer. The regulation blade 6 is made from a metal such as stainless steel, phosphor bronze, nickel silver, and the like. Here, the toner 7 is charged by friction.

The toner carrier 4 is subjected to a voltage with polarity identical to that of the toner 7. The charged thin-layered toner 7 on the toner carrier 4 is faced to the electrostatic latent image carrier 100 and adhered by the electric field to the electrostatic latent image on the electrostatic latent image carrier 100, after which development is performed to form a toner image.

The toner image on the electrostatic latent image carrier 100 is transferred by the transfer roller 11 onto a recording medium P such as an OHP sheet or a postcard. The toner image is fixed by the fixation means 12 onto the recording medium P to obtain an image. The fixation means 12 melts the toner 7 by heat and fixes the toner onto the recording medium P with a predetermined pressure.

Moreover, as shown in FIG. 3, the electric charger 1 is a brush type including a brush portion 1*a* and a conductive substrate 1*b* supporting the brush portion 1*a*. The brush portion 1*a* is made from a conductive rayon fiber having a specific electrical resistance of about $1 \times 10^4 \Omega \cdot cm$ and a thickness of 6 denier. 100 filaments (F) of this conductive rayon fiber are made into a single pile (P). This pile is woven with a density of about $10^5 (F/inch^2)$. The brush portion 1*a* has a length L=132 mm (width direction of the recording medium), width W=6 mm, and height H=5 mm.

The brush portion 1*a* may alternatively be made from a synthetic fiber such as polypropylene, acrylic, nylon, polyester, polycarbonate, and polyvinyl alcohol fiber. Moreover, the conductive substrate 1*b* may be a metal such as stainless steel, iron, copper, and aluminium, or semiconductor engineering plastic.

In this embodiment, the electric charger 1 is a fixed type. However, the electric charger 1 may alternatively be a brush roller, a charge roller, a conductive film, or the like.

Next, explanation will be given on actual image formation using the aforementioned charging device 21. The electrostatic latent image carrier 100 was set to a surface circumferential speed of 44 mm/sec and 90 mm/sec. The AC voltage frequency applied to the electric charger 1 was changed in each of the speed values to test for generation of Moire images and noise as well as charging non-uniformity. FIG. 6 shows the results of this test.

Using the circumeferential speed S of the electrostatic latent image carrier 100, the resolution R of the image to be formed, the number of dots D of the half-tone basic pattern 17, 19 (see FIG. 4 and FIG. 5), a frequency F which does not cause moire is calculated from the aforementioned formula [$R \times S/D$]. Here, explanation will be given as to why division by D (the number of dots of the half-tone basic pattern) is necessary.

When the resolution of the image to be formed is R (dot per inch) and the circumferential speed of the electrostatic latent image carrier 100 is S (inch/sec), actually $R \times S$ dots per second pass over the electric charger 1 during rotation of the electrostatic latent image carrier 100. This can be expressed in frequency as follows: $R \times S$ (Hz).

Figure 4:
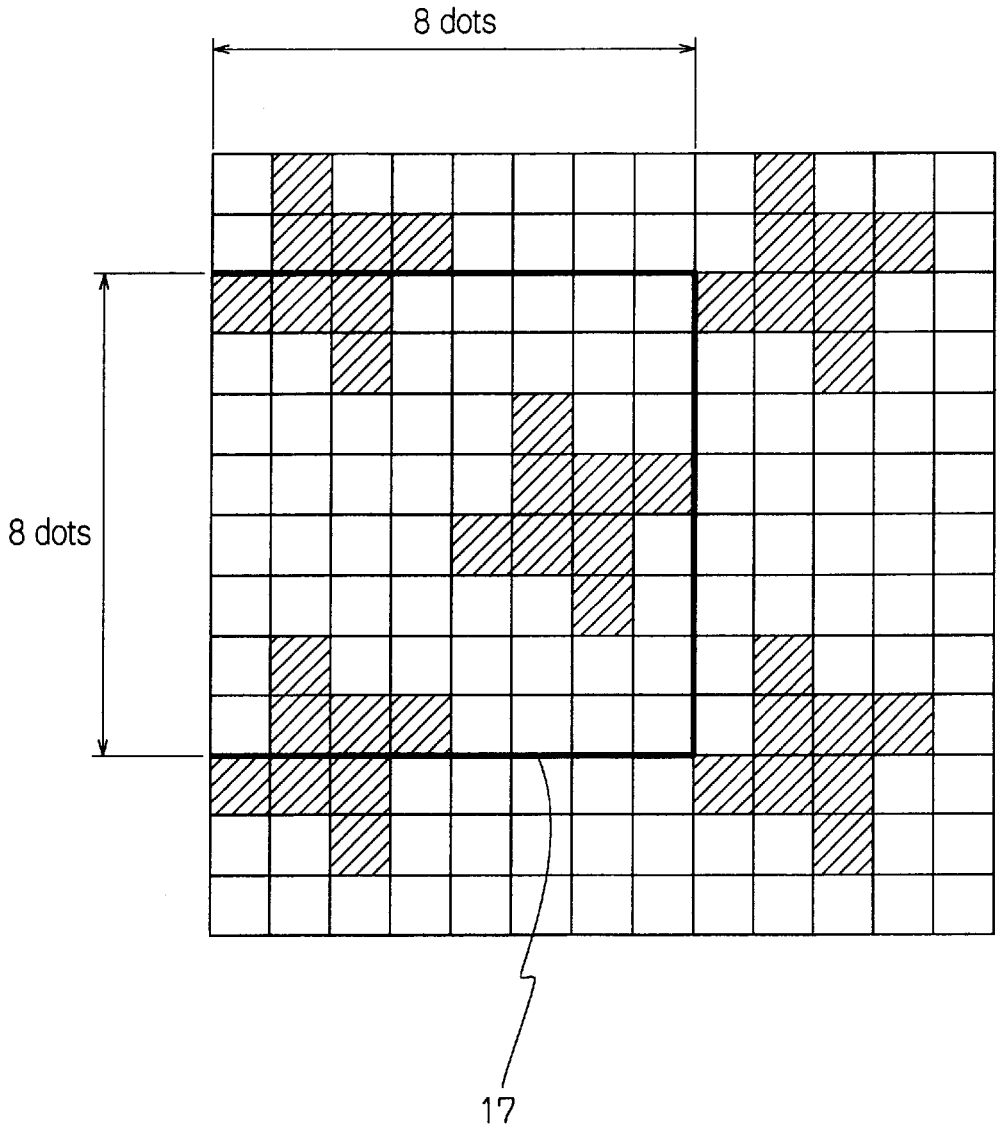
FIG. 4 shows a half-tone basic pattern of 8×8-dot matrix.
Figure 5:
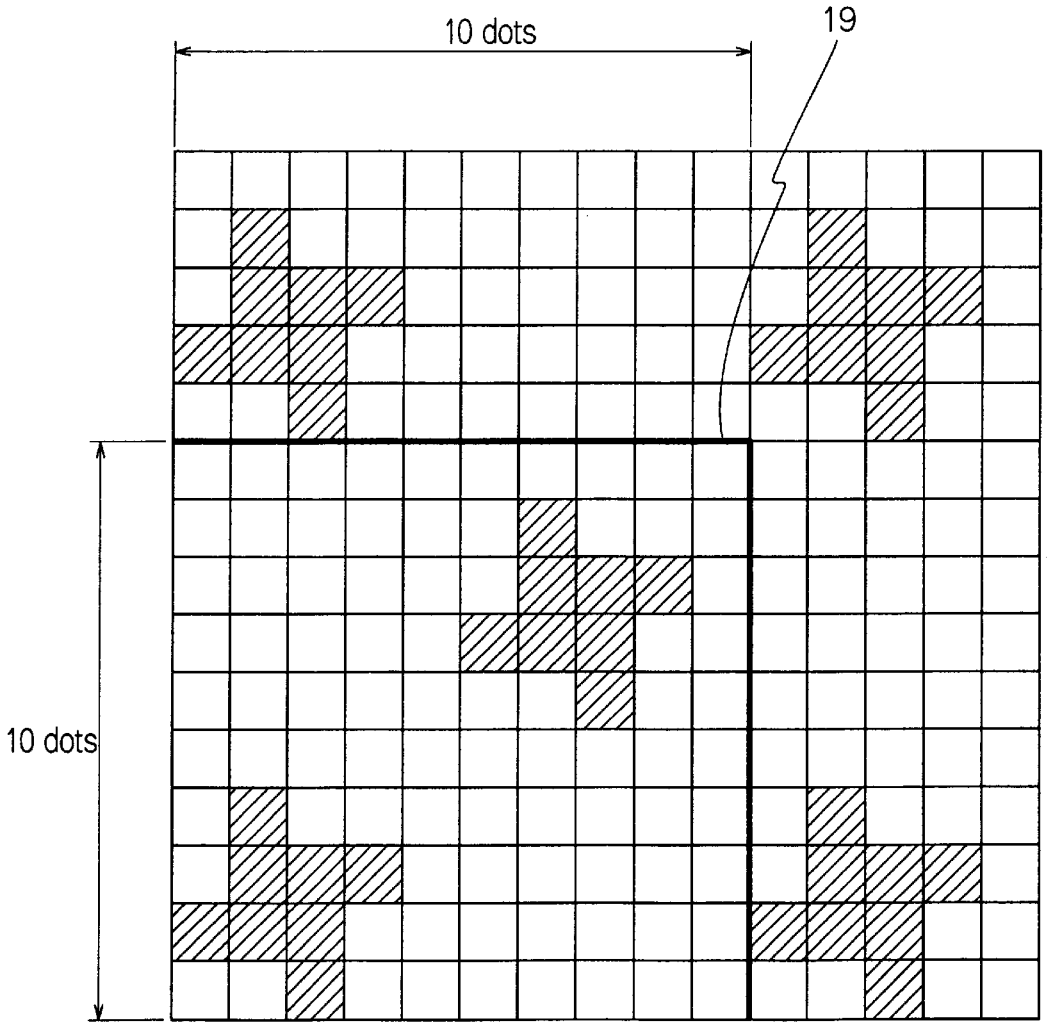
FIG. 5 shows a half tone basic pattern of 10×10-dot matrix.

However, as shown in FIG. 4, when a half-tone is to be expressed in an image formation apparatus performing a digital printing, the dot matrix usually has a basic pattern of 8×8 or 10×10. The basic pattern 17 shown in FIG. 4 consists of 8 dots in the horizontal and the vertical directions. In this case, it has been found that no Moire image is generated if the AC voltage frequency is greater than the number of basic patterns 17 which pass over the electric charger per unit time.

The quality of the image formed will not be deteriorated when the frequency is divided by the number of dots D in the horizontal or vertical direction of this basic pattern 17. For example, the basic pattern 17 formed as a matrix of 8×8 dots D can be converted into a frequency F as follows: $F = R \times S/8$. Moreover, when the number of dots D is 10×10, the frequency is calculated as follows: $F = R \times S/10$. In other words, it is possible to reduce the frequency calculated by R×S down to ⅛ or ⅒.

By overlapping a frequency greater than the frequency of this half-tone dot matrix, it is possible to improve the charging uniformity and make any Moire image less prominent as well as to suppress the generation of noise in such a low frequency region.

For example, when the electrostatic latent image carrier 100 has a circumferential speed S=17.3 (inch/sec) [44 mm/sec], theoretically, no Moire image will be generated at 69 Hz or above for a resolution of 400 (dot/inch), or at 103 Hz or above for a resolution of 600 (dot/inch). Moreover, when the electrostatic latent image carrier 100 has a circumferential speed S=3.54 (inch/sec) [90 mm/sec], theoretically, no Moire image will be generated at 212 Hz for the resolution of 600 (dot/inch).

These theoretical calculations are supported by the actual test results given in FIG. 6. That is, when the circumeferential speed S=17.3 (inch/sec) and the resolution is 400 (dot/inch), a Moire image and charge non-uniformity are slightly generated if the AC voltage frequency is 70 (Hz). However, when the frequency is set to 100 Hz, no Moire image is generated. Moreover, when the circumferential speed S=3.54 (inch/sec), and the resolution is 600 (dot/inch), a Moire image and charge non-uniformity are slightly generated if the AC voltage frequency is 200 Hz. However, if the frequency is set to 300 Hz, no Moire image is caused.

The aforementioned results were obtained by setting the DC voltage and the AC voltage at predetermined values. Similar results were obtained when the DC voltage applied to the electric charger 1 was changed in a range from −0.6 to −1.4 kV. Similar results were also obtained when the AC voltage amplitude was changed in a range from 300 V to 1000 V.

As for the noise generation between the electric charger 1 and the electrostatic latent image carrier 100, the test results show that noise is generated when the frequency is in a range of about 400 Hz. Accordingly, by setting the AC voltage frequency at a maximum of 400 Hz, it is possible to solve the problem of noise. Consequently, if the resolution is 600 (dots/inch) or so, no Moire image is caused, and no noise is generated from the electric charger.

As has been described above, in the charging device according to the present invention, the power source connected to the electric charger consists of a DC power source and an AC power source for applying a DC voltage in combination with an AC voltage to the electric charger. The frequency of the AC power source is set to a value corresponding to a latent image formed on the electrostatic latent image carrier. More specifically, the AC power source frequency F (Hz) is in the range defined as follows: $S \times R/D < F < 400$, wherein S (inch/sec) is the surface circumferential speed of the electrostatic latent image carrier, R (dot/inch) is the resolution of the image, and D (dots) is the number of dots in a basic pattern when the image to be formed is a half-tone image.

With the aforementioned configuration, even when forming a half-tone image, no Moire image is caused. Simultaneously with this, by applying an AC voltage of 400 Hz or so to the electric charger, an excellent effect can be obtained. That is, the electric charger will not cause an undesired noise.

Moreover, by setting the DC voltage to a predetermine value in a range from 0.5 to 1.4 kV, and the AC voltage amplitude to a predetermined value from 300 to 1000 V, it is possible to obtain a high-quality image.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-018733 (Filed on Jan. 30$^{th}$, 1998) including specification, claims, drawings and summary are incorporated herein by reference in its entirety.

What is claimed is:

1. A charging device comprising:

an electric charger that is in contact with an electrostatic latent image carrier and applies a predetermined voltage to said electrostatic latent image carrier; and a power source consisting of a DC power source and an AC power source for applying a DC voltage in combination with an AC voltage to said electric charger, wherein said AC voltage has a frequency corresponding to a level of half-tone of a latent image to be formed on said electrostatic latent image carrier.

2. A charging device as claimed in claim 1, wherein said frequency F (Hz) of said AC voltage is in a range defined by $S \times R/D < F < 400$, wherein S (inch/sec) is a surface circumferential speed of said electrostatic latent image carrier, R (dot/inch) is a resolution of the latent image, and D (dot) is a number of dots in a basic pattern forming the half-tone latent image.

3. A charging device as claimed in claim 2, wherein said DC voltage is a predetermined value in a range from 0.5 to 1.4 kV.

4. A charging device as claimed in claim 2, wherein said AC voltage has an amplitude of a predetermined value equal to or above 300 V.

5. A charging device as claimed in claim 4, wherein said AC voltage has an amplitude of a predetermined value equal to or below 1000 V.

6. A charging device as claimed in claim 1, wherein said DC voltage is a predetermined value in a range from 0.5 to 1.4 kV.

7. A charging device as claimed in claim 6, wherein said AC voltage has an amplitude of a predetermined value equal to or above 300 V.

8. A charging device as claimed in claim 7, wherein said AC voltage has an amplitude of a predetermined value equal to or below 1000 V.

9. A charging device as claimed in claim 1, wherein said AC voltage has an amplitude of a predetermined value equal to or above 300 V.

10. A charging device as claimed in claim 9, wherein said AC voltage has an amplitude of a predetermined value equal to or below 1000 V.

* * * * *